United States Patent [19]

Zdanys

[11] 3,968,338

[45] July 6, 1976

[54] ELECTRICAL SWITCH CONTROL

[75] Inventor: John Zdanys, Edwardsburg, Mich.

[73] Assignee: CTS Corporation, Elkhart, Ind.

[22] Filed: Aug. 13, 1974

[21] Appl. No.: 496,973

[52] U.S. Cl. ..... 200/68; 200/307

[51] Int. Cl.[2] ..... H01H 19/32

[58] Field of Search..... 200/68, 67 C, 307, 153 LB, 200/155, 153 LA, 153 L

[56] References Cited

UNITED STATES PATENTS

| | | | |
|---|---|---|---|
| 2,431,197 | 11/1947 | Platt et al. | 200/68 X |
| 3,227,822 | 1/1966 | Corey | 200/302 X |
| 3,324,261 | 6/1967 | Burns | 200/68 X |
| 3,349,358 | 10/1967 | Cassedy, Jr. | 200/68 X |
| 3,510,613 | 5/1970 | Barden et al. | 200/67 C |

FOREIGN PATENTS OR APPLICATIONS

| | | | |
|---|---|---|---|
| 788,559 | 6/1968 | Canada | 200/68 |

*Primary Examiner*—Herman J. Hohauser

[57] ABSTRACT

An electrical switch suitable for use singly or in tandem with other switches and/or with a variable resistance control. Each of the tandem switch housing sections defines a cavity and provides an annular bearing member rotatably supporting the periphery of a disk shaped switch actuator. The switch actuators close the cavities of the respective switch housing sections and each of the switch actuators carries a cam disposed near its periphery in an interference path with a contact spring biased between spaced projections on common contact means. The contact spring is provided with a pair of end members pivotally secured to the common contact means and a U-shaped section joined to the end members. The cam engages the bight portion of the U-shaped section for moving the legs of the U-shaped section into and out of engagement with first and second contact means disposed in each housing section. A plurality of lugs and lug receiving notches on each switch actuator provide the means to interconnect respective switch actuators for simultaneous rotation thereof.

11 Claims, 5 Drawing Figures

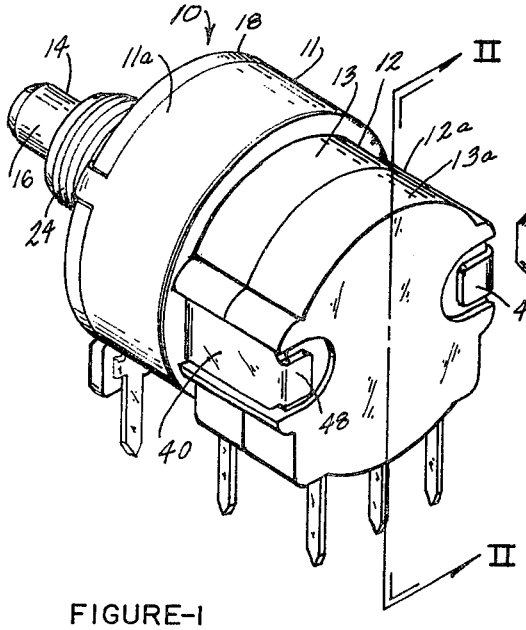
FIGURE-1
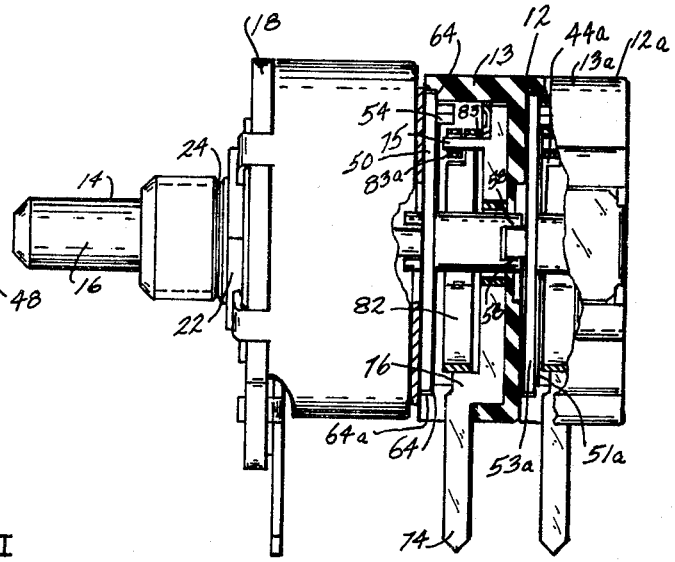
FIGURE-2
FIGURE-3
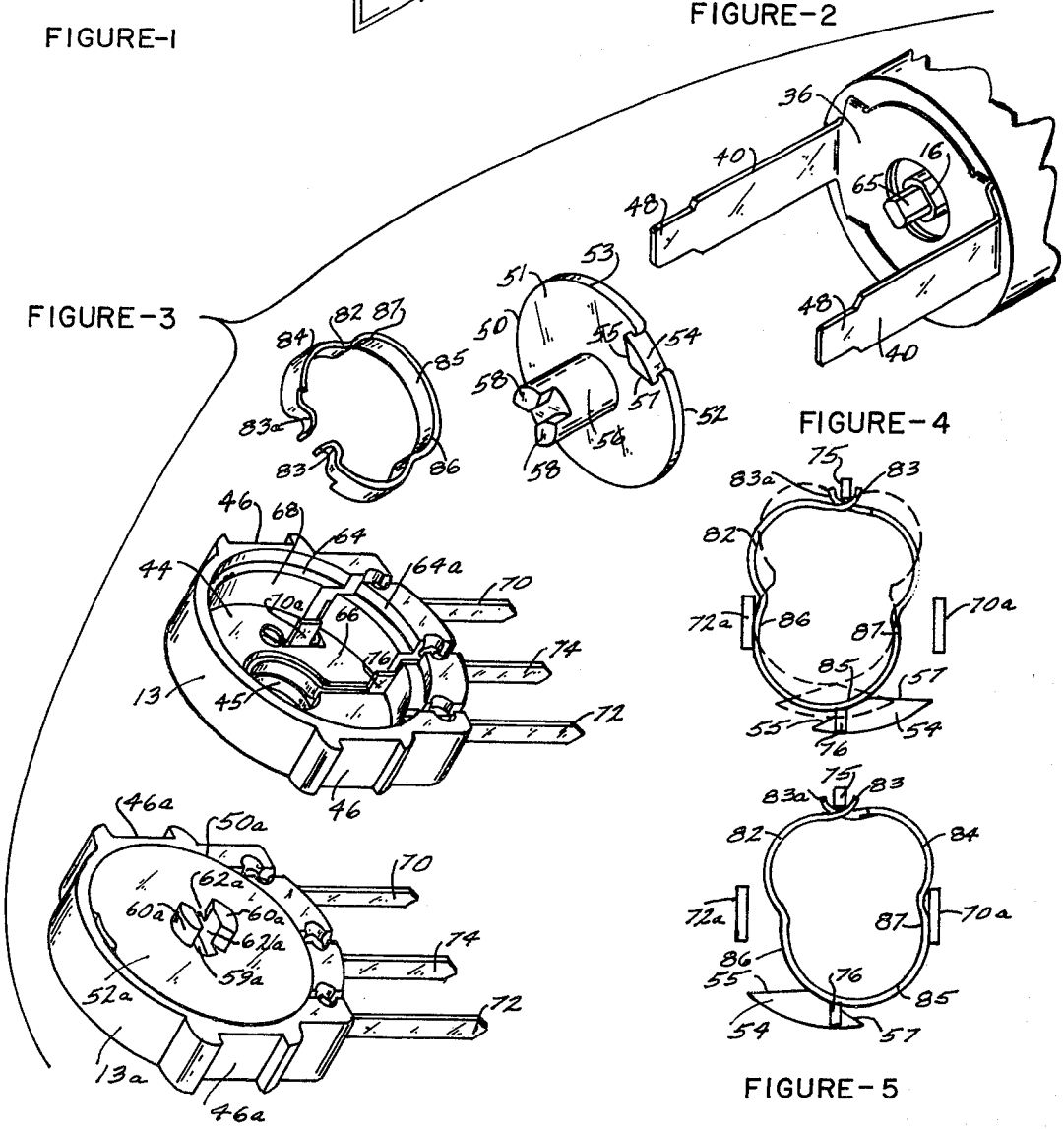
FIGURE-4
FIGURE-5

ELECTRICAL SWITCH CONTROL

The present invention relates to electrical controls, and more particularly, to an electrical switch used singly or in combination with a variable resistance control and to a plurality of such switches connected in tandem.

Prior art switches such as disclosed in U.S. Pat. Nos. 3,349,358 and 3,324,261 use a contact spring actuated by a cam and pivoted about a first contact member to open and close the electrical connection between the first contact member and a second contact member. In such switches the cam is connected through an actuator to a shaft turning in a bearing carried by a housing. As the cam engages and flexes the contact spring, the contact spring exerts spring pressure on the cam which pressure in turn is exerted on the shaft and against the bearing in the housing. A small diameter shaft rotating in a small diameter bearing causes a rather small bearing surface to withstand the spring pressure. Further increases in spring pressures by the cam moving in engagement with the contact spring are rather abruptly manifested at the bearing by the tight engagement of the shaft and bearing surface. This abrupt change in pressure or tight engagement is evidenced by abrupt switch action. It would therefore be desirable to provide a switch device evidencing less abrupt change in pressure and better switch feel as the cam engages the contact spring.

In the above mentioned U.S. Pat. No. 3,349,358 the cam is carried in close relationship to the rotating shaft resulting in more rapid angular turn per rotational travel of the cam with respect to the contact spring. Thus the alignment of the cam with respect to the cam follower of the contact spring is more critical for proper engagement of the cam with the cam follower, and to provide uniform spring pressure on the cam in both directions of cam movement. If the cam is positioned more radially outwardly from the rotating shaft as shown in the above mentioned U.S. Pat. No. 3,324,261, the angular rotation takes place over a greater range of cam travel; however, the further the cam is located from the center of the shaft, the greater the cam wobble or less stable is the cam movement with respect to the contact spring. It would therefore be desirable to provide a switch device wherein the cam is relatively free from wobble and yet there is a wide range of cam travel with respect to the contact spring.

In the above mentioned U.S. Pat. No. 3,349,358 the contact spring is biased between two separate contact members. The tolerance between two separate parts between which the contact spring is biased creates difficulty in providing a consistent contact pressure. This problem has been alleviated in the single-pole single-throw switch shown in above mentioned U.S. Pat. No. 3,324,261 by biasing the contact spring between a slot and a groove in the same contact member. However, in the above mentioned patent, the portion of the contact spring making electrical contact with each of the two contact members of the switch is the same portion of the contact spring mechanically engaged by the cam to pivot the contact spring into and out of engagement with the two contact members. Thus the same portion of the contact spring is both electrically and mechanically degradable and therefore decreases the life of the contact spring. It would therefore be desirable to provide a switch device in which the bias on the contact spring is essentially provided by a single contact member and wherein electrical and mechanical degradation of the contact spring is minimized.

Some switch applications often require a plurality of switch devices in tandem wherein each of the switch actuators of the switch devices rotates simultaneously. In such switch applications to prevent unnecessary malfunctions in the individual switch devices, it is often necesssary that the electrical contacts of each of the devices be electrically isolated in enclosed housings. It would therefore be desirable to fabricate a tandem switch control wherein a plurality of switch actuators are mechanically interconnected for simultaneous activation and wherein each of the actuators provides a cover plate for its respective housing.

Accordingly, it is an object of the present invention to provide a new and improved electrical control having the desirable features set forth above.

Still another object of the present invention is to provide a cam disposed near the periphery of a switch actuator for engaging a contact spring wherein the periphery of the actuator is rotatably supported in a housing.

Another object of the present invention resides in a new and improved contact spring minimizing electrical and mechanical degradation thereof and biased between points on a first contact means into engagement with a second contact means.

Still another object of the present invention is to provide a single-pole double-throw switch wherein a contact spring is biased between a post member and an abuttment member integral with a first contact and the ends of the contact spring are bent about the post member in stacked relationship.

Yet an additional object of the present invention is to provide a new and improved tandem switch control wherein first and second switch housing sections define cavities closed by interconnected switch actuators secured to an operating means for simultaneous rotation thereof.

Still a further object of the present invention resides in a tandem switch control wherein a first housing section defines a cavity and is provided with a peripheral annular bearing and the periphery of a switch actuator closing the cavity rotatably engages said bearing.

Further objects and advantages of the present invention will become apparent as the following description proceeds and the features of novelty characterizing the invention will be pointed out with particularity in the claims annexed to and forming a part of this specification.

Briefly, the present invention is concerned with a switch device used singly or in combination with a variable resistance control or another switch. Each switch housing section defines a cavity and is provided with an annular bearing rotatably supporting the periphery of a disk shaped switch actuator. The switch actuator closes the cavity and carries a cam near the periphery movable in an interference path with respect to a contact spring disposed in the housing. Each housing section carries a common contact means disposed intermediate first and second contact means and the contact spring defines a loop with the end portions thereof pivotally bent in stacked relationship about a post integral with the common contact means. The contact spring is biased between the post and an abuttment member integral with the common contact means into contact with the first and second contact means.

Integral with each of the end portions of the contact spring is a U-shaped member. The cam engages the bight portion of the U-shaped member for moving the legs of the U-shaped member into and out of engagement with the first and second contact means. Extending from a first surface of the switch actuators are projecting lugs for interlocking with lug receiving notches carried by a second surface of the switch actuators. Rotation of a control shaft engaging the lug receiving notches of a switch actuator rotates each of the cams of interlocked switch actuators in an interference path with respective contact springs.

For a better understanding of the present invention, reference may be had to the accompanying drawings, wherein the same reference numerals have been applied to like parts and wherein:

FIG. 1 is an isometric view of a tandem electrical switch in combination with the variable resistance control, built in accord with the present invention;

FIG. 2 is a partial sectional view taken along lines II—II of the electrical component shown in FIG. 1;

FIG. 3 is an exploded isometric view of the tandem electrical switch and a portion of the variable resistance control shown in FIG. 1;

FIGS. 4 and 5 show one of the switches of the tandem electrical switch of the electrical component of FIG. 1 in first and second stable positions.

Referring now more particularly to the drawings, an electrical component embodying one form of the invention is generally identified by the reference numeral 10. As shown in FIG. 1, the electrical component comprises a variable resistance control 11 and switches 12 and 12*a* comprising switch housing sections 13 and 13*a* molded of suitable plastic material. It should be understood that either of the switches 12 and 12*a* could be used singly or in tandem with any suitable electrical control and the switches are shown in combination with the variable resistance control for illustrative purposes only, the variable resistance control forming no part of the present invention. A control means 14 of brass or other suitable material includes a control shaft 16 supported by the front insulating base or plate 18 fixedly secured against the housing 11*a* of the variable resistance control 11. One of the means for mounting the electrical component 10 to a not shown mounting panel comprises a ground plate 22 provided with an externally threaded bushing 24 rotatably supporting the control shaft 16. After the threaded bushing 24 is inserted through a mounting panel, a lock washer and nut are used to lock the component into place on the panel. A coupling plate 36 suitably secured to the housing 11*a* is provided with integral coupling straps 40 for securing the switch housing sections 13 and 13*a* to the variable resistance control 11. Each of the housing sections 13 and 13*a* defines a cavity 44 and 44*a* and is provided with diametrical channels 46 and 46*a* for receiving the coupling straps 40. The coupling straps 40 each have end portions 48 suitably deformed to secure the housing sections 11*a*, 13 and 13*a* together. Housing section 13 being an intermediate section is provided with an aperture 45 to be hereinafter described.

In accordance with the present invention, each of the cavities 44 and 44*a* is closed by a disk shaped actuator 50 and 50*a* respectively molded of a suitable dielectric material and each of the actuators comprising a pair of spaced parallel surfaces 51 and 51*a* and 52 and 52*a*. Since the switch actuators are identical only portions of each switch actuator will be described in detail. As best seen in FIG. 3, carried integrally on the parallel surface 51, is a wedge shaped cam 54 disposed near the periphery of the switch actuator and a tubular portion 56 extends from the center of the switch actuator 50 terminating in a pair of lugs 58. Each of the surfaces 52 and 52*a* is provided with a center notch 59*a* and protrusions 60*a* extending from the surface 52*a* providing lug receiving notches 62*a*. The lugs 58 on the tubular portion 56 extend into the aperture 45 in the housing section 13 and engage the lug receiving notches 62*a* to secure the switch actuator 50*a* to the switch actuator 50. A projection 65 disposed at the end of the shaft 16 as seen in FIG. 3 engages the not shown lug receiving notches and center notch in surface 52 to secure the switch actuator 50 to the shaft 16. Rotation of the shaft 16 therefore rotates switch actuators 50 and 50*a* and their respective cams simultaneously within cavities 44 and 44*a*. In order to insure that the switch actuators 50 and 50*a* are properly positioned, one of the lugs is larger than the other thereby insuring entry into the lug receiving notches in only one position. It should be understood that the projection 65 at the end of the shaft 16 and the lugs on one surface of the switch actuators interfit the lug receiving notches on the other surface of the switch actuators so that individual switches can be interchanged and stacked still enabling simultaneous actuation of the switch actuators by rotation of the shaft 16.

Since each of the switches 12 and 12*a* are identical, only switch 12 will be described in detail. Housing section 13 comprises a back wall 66 with a rim 68 depending therefrom. The rim 68 terminates in an annular ledge 64 and an adjacent wall or ridge 64*a* normal to the ledge 64 forms an annular bearing. In accord with the present invention, the periphery of the disk shaped actuator 50 is rotatably supported by the annular bearing carried by the housing section 13. Specifically, as seen in FIGS. 2 and 3 the annular ledge 64 is disposed about the periphery of the housing section 13 and supports switch actuator 50 seated thereon with the periphery 53 of switch actuator 50 disposed adjacent wall 64*a*. First and second terminals 70 and 72 and common terminal 74 extend through suitable slots in the rim 68 with portions of terminals 70, 72 and 74 embedded in slots below the surface of the back wall 66. Integral with terminal 70 is a contact member 70*a* projecting above wall 66 within cavity 44 and integral with terminal 72 is a contact member 72*a* disposed opposite contact member 70*a* within cavity 44. The relationship of contact member 72*a* with respect to contact member 70*a* is illustrated in FIGS. 4 and 5 to be described hereinafter. As seen in FIGS. 2 and 3 a contact member or post 75 and an abuttment member 76 are integrally connected to terminal 74 and also project above wall 66. Portions of the housing sections 13 are heat swaged against the terminals 70, 72 and 74 in the slots to secure the terminals to the housing. As seen in FIGS. 2 and 3 a contact spring 82 is compressed between post 75 and abuttment member 76. The compression of contact spring 82 between post 75 and abuttment member 76 biases the contact spring 82 into contact with either contact member 70*a* or 72*a* as seen in FIGS. 4 and 5. The contact spring is preferably in the shape of a loop as seen in FIGS. 2 and 3 with two ends 83 and 83*a* pivotally secured in stacked relationship to the post 75. Integral with each of the ends 83 and 83*a* is a U-shaped portion 84 having a bight or cam follower segment 85 and legs 86 and 87.

For the purpose of shifting the contact spring 82 slideably into and out of engagement with the contacts 70*a* and 72*a*, the cam 54 is provided with cam surfaces 55 and 57 movable in an interference path with the cam follower segment 85 of the contact spring 82. Assuming the switch is in the position as shown in FIG. 4, i.e., the contact spring 82 in engagement with the contact 72*a*, rotation of the cam 54 in a clockwise direction causes the surface 55 of the cam to engage the cam follower segment 85 and continued clockwise rotation of the cam 54 forces the cam follower segment upwardly toward post 75 causing the contact spring to compress and thereby store energy. The energy stored in contact spring 82 engaging the cam 54 is transmitted radially outwardly through the cam 54 to the switch actuator 50 engaging the wall 64*a* at periphery 53. Due to the relatively large diameters of the wall 64*a* and the switch actuator 50, the energy stored in spring 82 is distributed over a relatively large surface area of engagement between the periphery 53 and the wall 64*a*.

The upward movement of the cam follower segment 85 moves the cam follower segment away from contact with the abuttment member 76 as seen by the dotted lines in FIG. 4, the post 75 maintaining the electrical contact between the terminals 74 and 72. Although abuttment member 76 is an integral portion of terminal 74, the abuttment member 76 need not be electrically conductive and could be a suitable insulating material. As seen by the dotted lines in FIG. 4, as the cam 54 continues to rotate in the clockwise direction, the apex of the cam joining the surfaces 55 and 57 eventually engages the apex of the cam follower segment 85 of the contact spring 82 further storing energy in the contact spring 82. As the apex of the cam passes the apex of the cam follower segment 85, the cam surface 57 engages the cam follower segment 85 and the slant of the surface 57 away from contact 72*a* allows the release of the stored energy in the contact spring 82 snapping the leg 87 into engagement with contact member 70*a* as seen in FIG. 5 as the ends 83 and 83*a* pivot about the post or pivot means 75. As seen in FIG. 5, with the leg 87 in contact with contact member 70*a*, the leg 86 has been disengaged from the contact member 72*a* and the cam follower segment 85 is again in engagement with abuttment member 76. Up until the moment that the leg 86 is snapped out of engagement with contact 72*a*, the leg 86 is in contact with contact member 72*a* and the contact spring is in electrical contact with terminal 74 through post 75 due to the pivotal engagement of the ends 83 and 83*a* with post 75. It should be noted that electrical connection between the common terminal 74 and the terminals 70 and 72 is made through legs 86 and 87 and ends 83 and 83*a* of the contact spring whereas the mechanical engagement of the cam surfaces 55 and 57 with the contact spring 82 is through cam follower segment 85. This minimizes the electrical and mechanical degradation of the contact spring at points along the contact spring and further enhances the life of the contact spring 82. Since a portion of the terminal 74 is embedded within the housing section 13 below the surface 66, the contact spring 82 is free to slide along the surface 66 between contacts 70*a* and 72*a*.

In accord with the present invention, as seen in FIGS. 2 and 3, the cam 54 is disposed near the periphery of switch actuator 50 and therefore there is a relatively long length of rotational travel of the cam 54 with respect to the cam follower segment 85. Since the cam is disposed near the periphery of the switch actuator 50 and the switch actuator is supported by the ledge 64 and wall 64*a* disposed at the periphery of the housing section 13, the rotational movement of the cam 54 is relatively stable. To shift the spring contact 82 out of engagement with contact 70*a* and into engagement with contact 72*a*, the cam 54 is moved in a counterclockwise direction, the cam surface 57 initially engaging cam follower segment 85 and compressing the contact spring 82. The compression of the contact spring 82 by cam 54 disengages the cam follower 85 from abuttment member 76. Continued rotation in the counterclockwise direction of the cam beyond the engagement of the apex of the cam with the apex of the cam follower moves the cam surface 55 into engagement with cam follower portion 85 releasing the energy stored in the contact spring and snapping the leg 86 into contact with contact member 72*a*.

While there has been illustrated and described what is at present considered to be a preferred embodiment of the present invention, it will be appreciated that numerous modifications are likely to occur to those skilled in the art and it is intended in the appended claims to cover all those changes and modifications which fall within the scope and true spirit of the present invention.

What is claimed as new and desired to be secured by Letters Patent of the United States is:

1. In a tandem switch control, the combination of first and second housing sections, each housing section defining a cavity, said first housing section being provided with an aperture, an annular bearing member carried by each of said housing sections, first and second contact means disposed within each of said housing sections, a common contact means disposed between said first and second contact means in each of said housing sections, a contact spring disposed within each of said housing sections engaging said first contact means and said common contact means in a first stable position and engaging said second contact means and said common contact means in a second stable position, a first switch actuator closing the cavity of said first housing section, said first switch actuator being formed in the shape of a disk and being provided with a first surface, a pair of lugs extending forwardly from said first surface into the aperture in said first housing section, a wedge shaped cam carried by said first surface and disposed near the periphery of said first switch actuator for rotation in an interference path with the contact spring in said first housing section, a second switch actuator closing the cavity of said second housing section, said second switch actuator being formed in the shape of a disk and being provided with first and second spaced surfaces, said second spaced surface being provided with lug receiving notches engaging said pair of lugs for securing said first switch actuator to said second switch actuator, a wedge shaped cam carried by said first spaced surface of the second switch actuator and disposed near the periphery of said second switch actuator for rotation in an interference path with the contact spring disposed in said second housing section, and a shaft engaging the first switch actuator for simultaneous rotation of said switch actuators, each of said bearing members being disposed near the periphery of the housing sections and comprising a ridge member and an annular wall disposed adjacent said ridge member, said switch actuator abutting said ridge, said annular wall being disposed adjacent the periphery of said actuator.

2. The tandem switch control of claim 1, wherein each of said common contact means comprises a post and an abuttment member spaced apart from said post, said contact spring being biased between said post and abuttment member, said contact spring defining a loop, the ends of said loop being stacked in pivotal engagement with said post.

3. An electrical switch comprising a housing having a rear wall and an annular rim defining a cavity, an annular bearing member carried by the housing and having a diameter substantially the same as the diameter of the rim, first and second spaced contact means disposed in the housing, a contact spring engaging the first contact means and movable with respect to the second contact means, an actuating means having a periphery engaging the rim, and a cam carried by the actuating means for movement in an interference path with said contact spring for moving the contact spring into and out of engagement with said second contact means, the periphery of said actuating means being rotatably supported by said annular bearing member.

4. The electrical switch of claim 3, wherein said housing defines a cavity and said annular bearing member is a ridge disposed about the periphery of said housing, said actuating means being disposed adjacent said ridge and enclosing said cavity.

5. The electrical switch of claim 4, wherein said actuating means is a disk and wherein said cam is disposed near the periphery of said disk intermediate said ridge and said contact spring.

6. The electrical switch of claim 3, wherein said first contact means comprises a post and the ends of the contact spring are bent in stacked relationship along the axis of said post for pivotal movement thereabout.

7. The electrical control of claim 6, wherein the contact spring comprises a U-shaped section disposed between said ends, the U-shaped section being defined by a pair of legs and a bight portion, one leg of the U-shaped section being movable into and out of electrical contact with the second contact means, the bight portion of the U-shaped section defining a cam follower whereby upon rotation of the actuating means said cam engages the bight portion and compresses said contact spring and moves said one leg into or out of electrical contact with said second contact means.

8. An electric switch comprising a housing having a first surface, first and second spaced contact means carried by the housing, common contact means disposed within the housing in spaced relationship with said first and second contact means, an abuttment member carried by the common contact means, pivot means carried by said common contact means in spaced relationship with said abuttment member, a contact spring biased between said abuttment member and pivot means into electrical contact with one of said first and second contact means, a cam movable in an interference path with said contact spring, and an acutator for moving said cam, said cam adapted to move the contact spring slideably along said first surface into and out of engagement with said first and second contact means.

9. The electric switch of claim 8, wherein said contact spring comprises a cam follower portion and said contact spring is biased between said pivot means and said abuttment member and said first contact means in a first stable position and between said pivot means and said abuttment member and said second contact means in a second stable position, said cam being engageable with said cam follower portion to compress said contact spring out of contact with said abuttment member when moving between said first and second stable positions.

10. The electrical switch of claim 9, wherein said housing defines a cavity and is provided with an aperture, and wherein said actuator is a disc closing said cavity and comprises a projecting member extending into said aperture.

11. A tandem switch comprising first and second housing sections, each housing section being provided with a cavity and carrying first and second contact means, a contact spring pivotally disposed in each housing section in engagement with said first contact means, a switch actuator closing the cavity in each housing section, the first housing section being provided with an aperture, the switch actuator closing the cavity of said first housing section comprising connecting lugs extending into the aperture, said switch actuator closing the cavity of said second housing section being provided with lug receiving notches, said lugs engaging the lug receiving notches and securing the switch actuators together, a cam carried on the surface of each of the switch actuators, one of the cams being movable in an interference path with the contact spring disposed in the first housing section, the other of the cams being movable in an interference path with the contact spring disposed in the second housing section, control means connected to one of said switch actuators, said switch actuators being interconnected whereby rotation of the shaft rotates each of the cams in an interference path with the respective contact spring moving said contact springs into engagement with said second contact means.

* * * * *